US007591633B2

(12) United States Patent
Hancock

(10) Patent No.: US 7,591,633 B2
(45) **Date of Patent: *Sep. 22, 2009**

(54) CENTRIFUGAL BLOWER FOR AIR HANDLING EQUIPMENT

(75) Inventor: Stephen S. Hancock, Flint, TX (US)

(73) Assignee: Trane International, Inc., Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/225,471

(22) Filed: Sep. 13, 2005

(65) Prior Publication Data

US 2007/0059167 A1 Mar. 15, 2007

(51) Int. Cl.
*F04D 29/44* (2006.01)

(52) U.S. Cl. ..... 415/206; 415/211.2; 415/912

(58) Field of Classification Search ..... 415/912, 415/206, 224, 203, 204, 207; 416/187, 186 R
See application file for complete search history.

(56) References Cited

U.S. PATENT DOCUMENTS 3,098,603 A * 7/1963 Baker ..... 415/204
3,231,176 A * 1/1966 Bowen ..... 415/102
3,278,115 A * 10/1966 White et. al. ..... 415/204
3,627,440 A * 12/1971 Wood ..... 415/206
3,775,029 A * 11/1973 Ranz ..... 415/206
6,299,409 B1 * 10/2001 Matsunaga et al. ..... 415/206
7,144,219 B2 * 12/2006 Hancock ..... 415/212.1
2004/0253092 A1 12/2004 Hancock
2004/0253098 A1 12/2004 Hancock
2004/0253099 A1 12/2004 Hancock
2004/0253101 A1 12/2004 Hancock

FOREIGN PATENT DOCUMENTS

JP 52046503 A * 4/1977

* cited by examiner

*Primary Examiner*—Richard Edgar
(74) *Attorney, Agent, or Firm*—Conley Rose, P.C.; J. Robert Brown, Jr.

(57) ABSTRACT

An air handling blower for HVAC equipment includes a blower housing adapted to accommodate centrifugal impellers of selected inside and outside diameters of the impeller blades wherein the inside diameter of the largest diameter impeller accommodated by the housing is not less than the outside diameter of the smallest diameter impeller accommodated by the housing without loss of performance. The blower housing preferably has a continuously increasing cross-sectional airflow area for air being discharged from the blower and extending from a cutoff edge to an outlet.

23 Claims, 6 Drawing Sheets

CENTRIFUGAL BLOWER FOR AIR HANDLING EQUIPMENT

BACKGROUND OF THE INVENTION

Motor driven centrifugal blowers for air handling equipment, such as heating, ventilating and air conditioning (HVAC) systems are well known. A typical air handling blower includes a scroll-like housing within which is mounted a centrifugal blower wheel or impeller of a selected diameter and axial length and wherein the housing is adapted or "sized" to operate efficiently with a particular blower wheel or impeller.

However, there are many applications of air handling equipment wherein it is desirable to select the impeller size to accommodate a particular airflow requirement, impeller rotational speed and static or blower discharge pressure requirement, or a change in such requirements. Such performance requirements or desiderata in the equipment market may dictate that many different size blower wheels and associated blower housings be designed and fabricated to meet particular performance requirements of the blower application. Of course, such a situation increases the costs associated with providing products to suit each blower application.

Accordingly, there has been a continuing need and desire to reduce the costs and product complexity associated with providing various blower wheel sizes and associated blower housings which will accommodate the various specific wheel or impeller sizes while meeting the performance requirements of a blower, without adverse effects of increased noise produced by the blower, as well as other parameters of blower performance and operation known to those skilled in the art. In accordance with the present invention, it has been discovered that a particular configuration of blower housing in combination with a particular range of centrifugal impeller sizes provides for operation without sacrificing blower performance and while maintaining reduced noise levels.

SUMMARY OF THE INVENTION

The present invention provides an improved air handling blower for use, in particular, with heating, ventilating and air conditioning (HVAC) equipment wherein a blower housing accommodates blower wheels or impellers of selected different sizes and performance capability while maintaining desirable performance parameters and acoustic emission or "noise" levels.

In accordance with one aspect of the present invention, a combination of a centrifugal blower scroll type housing and a centrifugal blower wheel or impeller is provided wherein an impeller providing for high airflow and/or static pressure, in combination with the blower housing is such that the housing air inlet port or orifice has a diameter that is no smaller than the inner diameter of the blades of the largest impeller that the housing will accommodate while the blower housing inlet port or orifice diameter is also no larger than the outer diameter of the smallest impeller or wheel that the housing will accommodate.

Accordingly, the invention contemplates the provision of an air handling blower having a scroll-like housing with an air inlet port or orifice which will accommodate centrifugal blower wheels or impellers of various sizes wherein the outer diameter of the smallest wheel is generally no less than the inner diameter of the largest wheel.

Still further, in accordance with the invention, a centrifugal air handling blower is provided wherein a blower housing having a somewhat spiral or scroll-like air flowpath configuration includes an improved blower wheel cutoff edge configuration having first and second ends and a midsection operable to accommodate a blower wheel or impeller of a selected range of outside diameters wherein the efficiency of the blower is improved, as compared with conventional centrifugal air handling blowers, and blower acoustic emissions are reduced for the same range of blower wheel diameters.

Accordingly, an improved blower configuration is provided by the invention wherein, for a particular size of scroll-like blower housing, a range of blower impeller sizes may be provided wherein such impellers have a particular range of diameters which may be used with the blower housing without reduction in efficiency or increase in noise generated through the use of impellers of various sizes. Still further, the combination of a scroll-like blower housing and range of blower impeller sizes in accordance with the invention provides for obtaining a predetermined air flow rate and discharge pressure required for a blower application at a rotational speed that corresponds to an efficient operating point for the blower drive motor. This flexibility is particularly advantageous for applications utilizing so-called PSC (permanent split capacitor) motors which have an efficiency peak at about ninety percent of synchronous speed. The efficiency of such motors tends to deteriorate at rotational speeds which deviate from the ninety percent of synchronous speed value.

Those skilled in the art will further appreciate the above-mentioned advantages and superior features of the invention, together with other important aspects thereof upon reading the detailed description which follows in conjunction with the drawings.

DETAILED DESCRIPTION OF A PREFERRED EMBODIMENT

Figure 1:
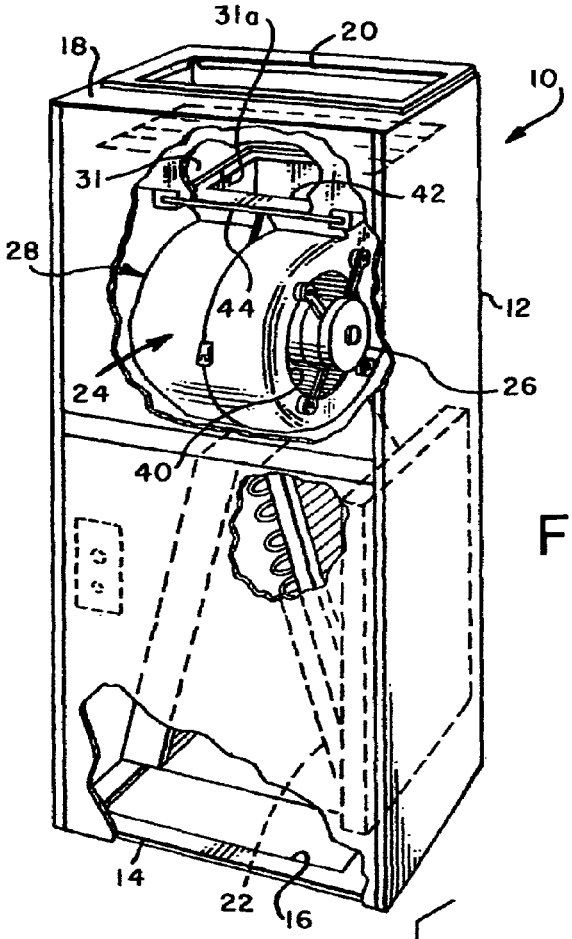
FIG. 1 is a perspective view, partially cutaway, illustrating air handling equipment utilizing an improved air handling blower of the present invention.

In the description which follows, like parts are marked throughout the specification and drawing with the same reference numerals, respectively. The drawing figures are not necessarily to scale and certain features may be shown exaggerated in scale or in somewhat generalized form in the interest of clarity and conciseness.

Referring to FIG. 1, there is illustrated a heating, ventilating and air conditioning unit (HVAC), generally designated by the numeral 10, characterized by a generally rectangular cabinet 12 having a bottom wall 14 defining an air inlet opening 16 and a top wall 18 defining an air outlet opening 20. The unit 10 may comprise a so-called air handler including an air conditioning evaporator coil 22 disposed therein in the flowpath of air passing from the inlet 16 to the outlet 20. An air handling blower in accordance with the invention is disposed in the cabinet 12 and generally designated by the numeral 24. The blower 24 includes a somewhat conventional electric drive motor 26 mounted on a blower housing in accordance with the invention and generally designated by the numeral 28. Blower housing 28 is characterized by a generally spiral or scroll-like configuration which may be substantially like that described and claimed in U.S. published patent applications nos. US2004/0253098A1, US2004/0253099A1 and US2004/0253101A1, all to Stephen S. Hancock and all assigned to the assignee of the present invention. The subject matter of the above-identified published patent applications is incorporated herein by reference.

Figure 2:
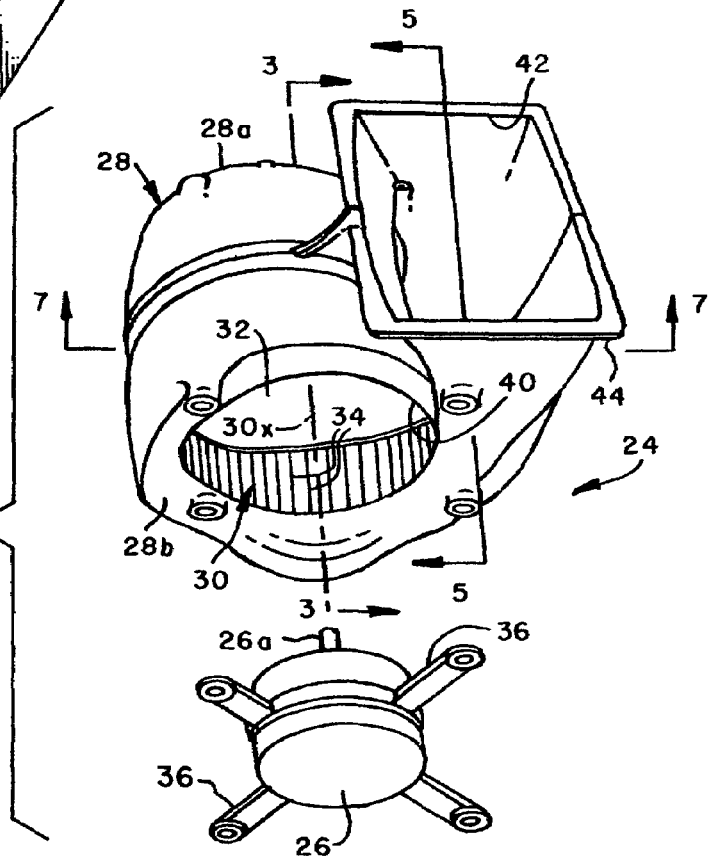
FIG. 2 is an exploded perspective view of an improved air handling blower in accordance with the invention.

Referring further to FIG. 1, and FIG. 2, the centrifugal blower 24 also includes a centrifugal blower wheel or impeller 30 disposed in the housing 28, FIG. 2. Impeller 30 is of generally conventional construction, comprising a so-called squirrel cage type impeller with a central transverse disc-like support member 32 including a hub 32*a*, see FIG. 7, and plural circumferentially spaced, generally radially outwardly projecting impeller blades 34. Blades 34 may be forward or backward curved and are illustrated as backward curved with respect to the direction of rotation about axis 30*x*, FIGS. 2, 3, 4 and 7, which direction is indicated by arrow 30*y* in FIG. 7. Impeller 30 is adapted to be drivenly connected to drive motor 26, which motor is provided with a shaft 26*a* drivingly engaged with hub 32*a*, FIG. 3, and motor 26 also includes a support bracket 36 adapted for mounting the motor on the blower housing 28 in a selected position on one of opposite sides thereof.

Figure 3:
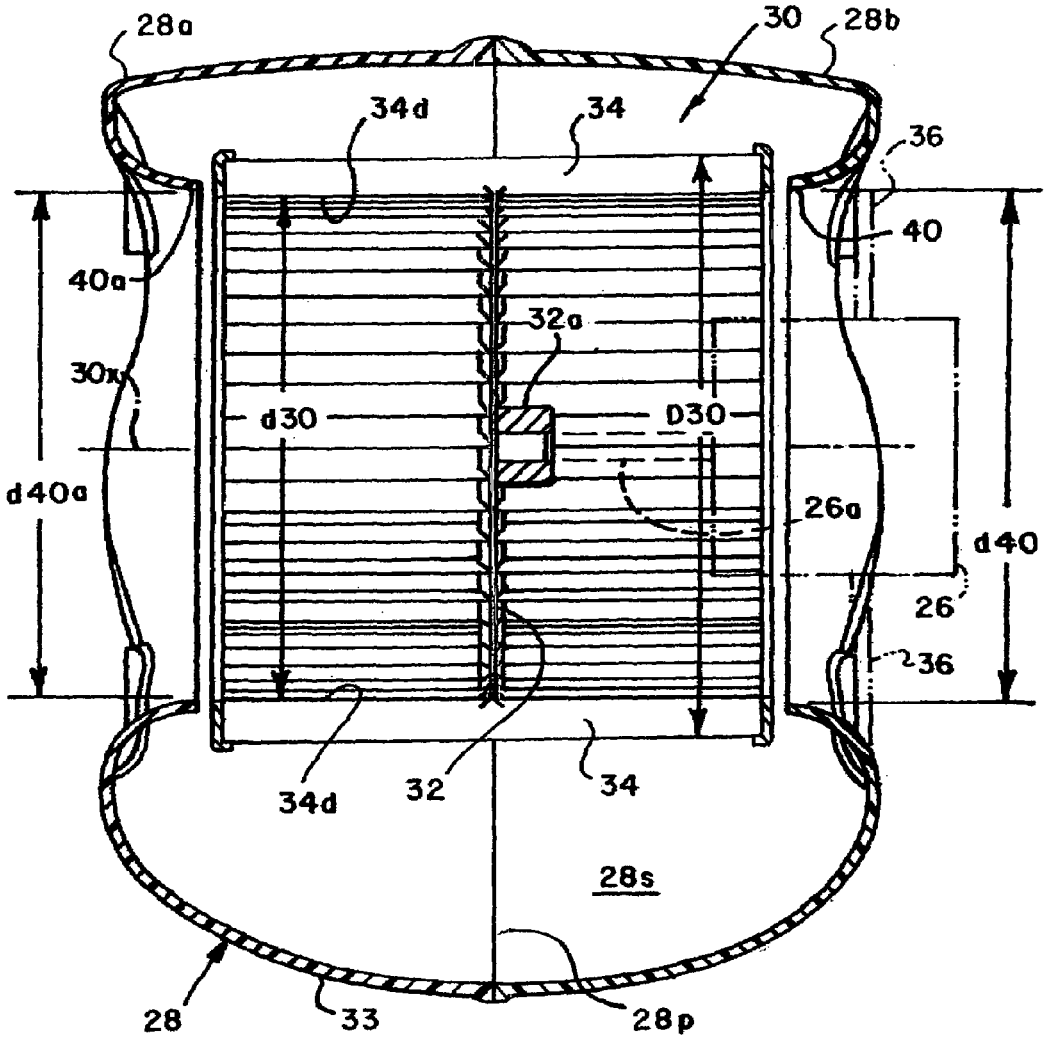
FIG. 3 is a section view taken generally along the line 3-3 of FIG. 2 and illustrating a blower wheel or impeller having a first or maximum diameter.
Figure 4:
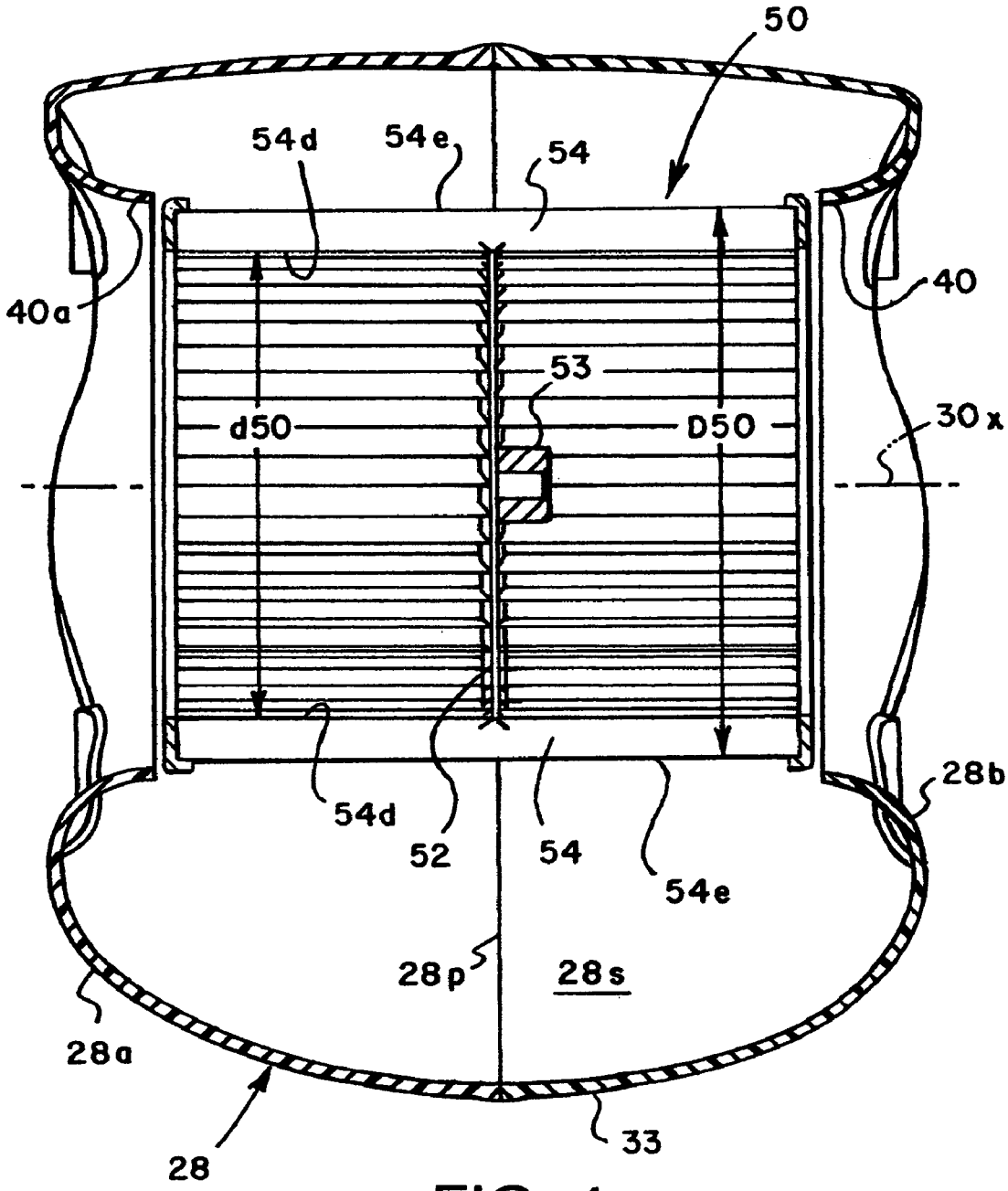
FIG. 4 is a section view similar to FIG. 3 but showing an impeller of minimum outside diameter mounted within the same blower housing.

Blower housing 28 is provided with opposed air inlet ports or orifices 40 and 40*a*, FIGS. 3 and 4. Ports or orifices 40 and 40*a* are preferably generally circular in configuration and are provided on opposite sides of the blower 28, as shown. Accordingly, the dimensions which define the ports 40 and 40*a*, and the air flowpath area of the ports, are the respective port diameters d40 and d40*a*, FIG. 3. Blower housing 28 includes opposed housing members 28*a* and 28*b* which may be constructed as described in the above-referenced published patent applications and which jointly define a blower air outlet port 42 delimited by a generally rectangular perimeter flange 44, see FIGS. 2 and 7. Flange 44 is adapted to assist in supporting blower 24 at a transverse wall 31 formed in cabinet 12, as illustrated in FIG. 1, and having a port or opening 31*a* aligned with blower outlet or discharge port 42.

Figure 7:
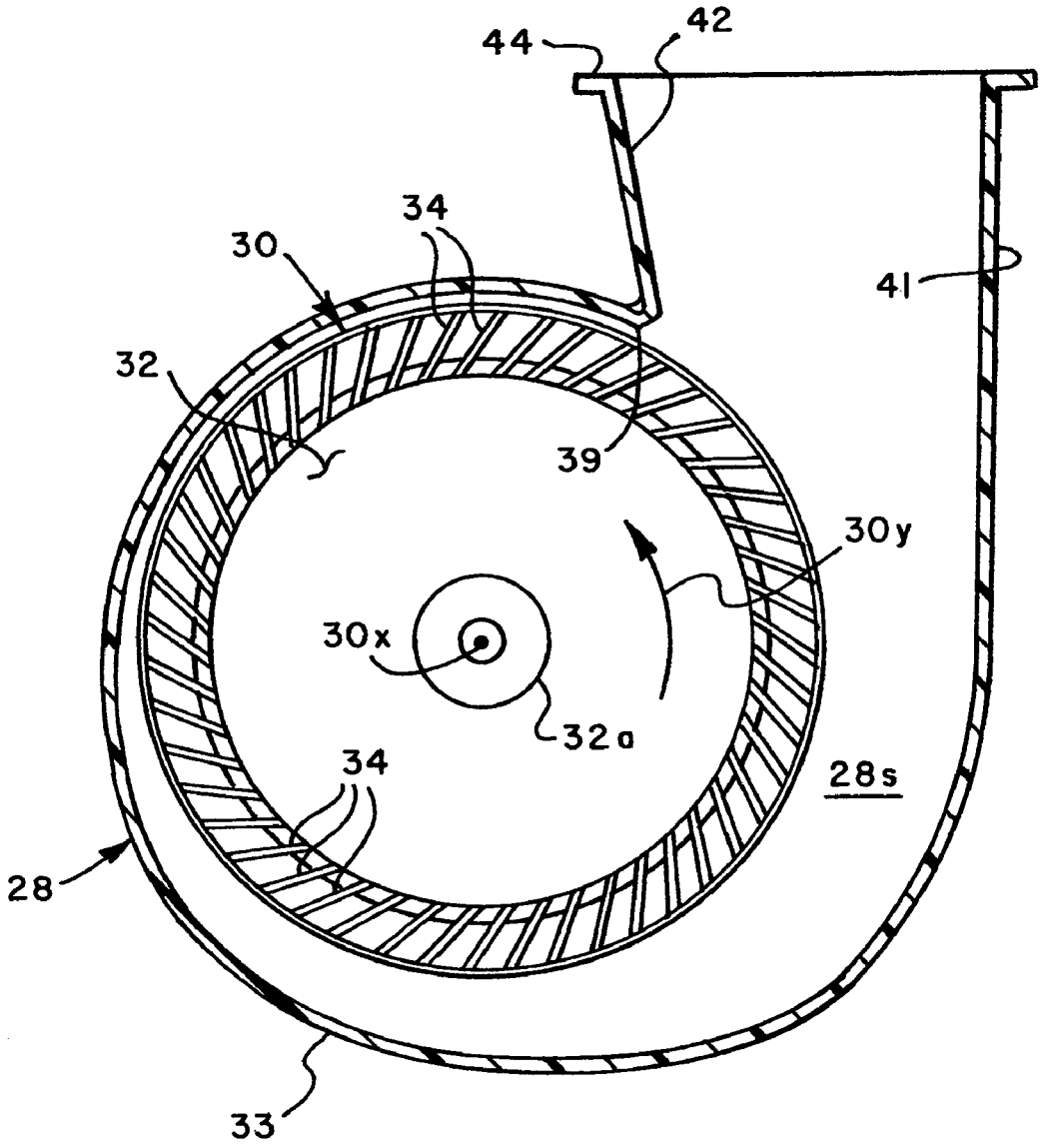
FIG. 7 is a section view taken generally along line 7-7 of FIG. 2.

As shown in FIG. 7, blower impeller 30 is provided with circumferentially spaced, preferably backward curved blades 34, although other arrangements of blades in a generally centrifugal blower wheel or impeller may be provided while enjoying the benefits of the present invention. FIG. 7 also illustrates how an outer peripheral wall 33 of blower housing 28 is disposed generally at an increasing radius with respect to axis 30*x* from a blower cutoff edge 39, FIG. 7, in a counterclockwise direction from the cutoff edge, to an air discharge duct portion 41 of the blower housing disposed just upstream of or prior to outlet port 42. However, blower housing 28 is also, preferably, of a geometry as described in the afore mentioned published patent applications incorporated herein by reference. The interior airflow space 28*s* of blower housing 28, FIGS. 3, 4 and 7, is arranged to provide a substantially constant increasing cross-sectional flow area between cutoff edge 39 and the air discharge portion 41 of the blower housing.

Figure 5:
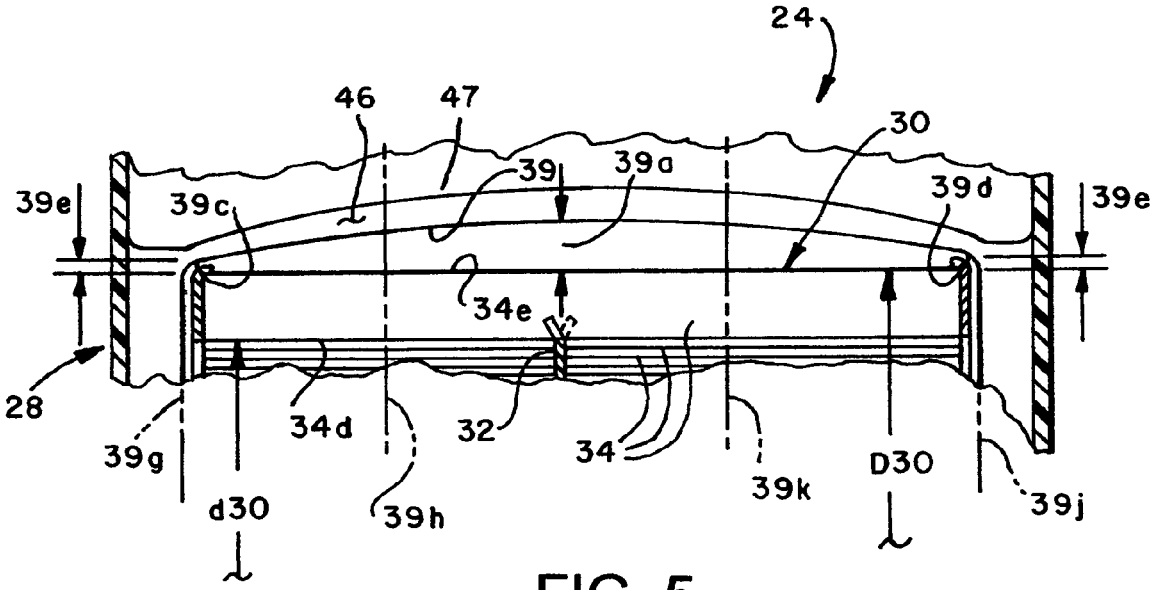
FIG. 5 is a detail section view taken generally along the line 5-5 of FIG. 2 showing the relationship between the blower cutoff edge and the outside diameter of an impeller of maximum diameter.

Referring now to FIG. 3, impeller 30 is further illustrated with respect to its relationship to the inlet port 40 and the opposing coaxially aligned inlet port or orifice 40*a*. In fact, blower housing 28 may be substantially symmetrical about a plane defined by a parting line 28*p*, FIGS. 3 and 4. It will be noted in FIG. 3 that the inner or inside diameter d30 of impeller 30, defined as the diametral distance between the radially innermost edges 34*d* of impeller blades 34, is approximately equal to the diameters of the orifices or ports 40 and 40*a*. For the configuration of a particular blower housing 28 constructed in accordance with the present invention an impeller 30 having an outside diameter D30 would be closely adjacent the cutoff edge 39, see FIG. 5 also, particularly at the opposed lateral edges 39*c* and 39*d*. In other words, the radially outermost edges 34*e* of impeller blades 34 would be at their closest proximity to the cutoff edge 39, as shown in FIG. 5. Cutoff edge 39 preferably forms an elliptical shape, as taught by published patent application US 2004/0253099A1.

still further, a first clearance distance 39*e* between the outside diameter D30 of the impeller 30 and the cutoff edge 39 at cutoff edge locations 39*c* and 39*d* ranges, preferably, from a minimum of 0.5% of the impeller outside diameter to a maximum of 5.0% of the impeller outside diameter while a second distance, measured generally at the midpoint of the elliptical cutoff edge 39, indicated by 39*a*, is greater than the first distance. In one preferred embodiment, the first distance 39*e* is approximately 2.0% of the impeller diameter D30 while the second distance 39*a* is approximately 6.0% of the impeller diameter D30. Of course, in accordance with the teaching of the above-identified published patent application, the edge 39 is symmetrical and continuous about mid point 39*a*, forming, preferably, an elliptical shape. The cutoff portion of the blower housing 28 is further defined by face 46 which is formed as an area between cutoff edge 39 and a so-called discharge side edge 47, FIG. 5. Viewing FIG. 5, the cutoff edge 39 includes a first end portion ranging between first and second positions 39*g* and 39*h*, a second end portion ranging between third a fourth position 39*j* and 39*k*, and a cutoff edge midsection portion extending between the first and second end portions. The cutoff edge midsection between positions 39*h* and 39*k* forms an acoustic emissions reduction portion of the cutoff edge where the elliptical cutoff edge 39 has a first flattened arc relative to the axis 30*x* promoting quieter air flow, whereas the portions on either side of the cutoff edge midsection portion have a second sharper arc relative to the axis 30*x* inhibit recirculation of air and promote stability in operation of the blower.

Figure 6:
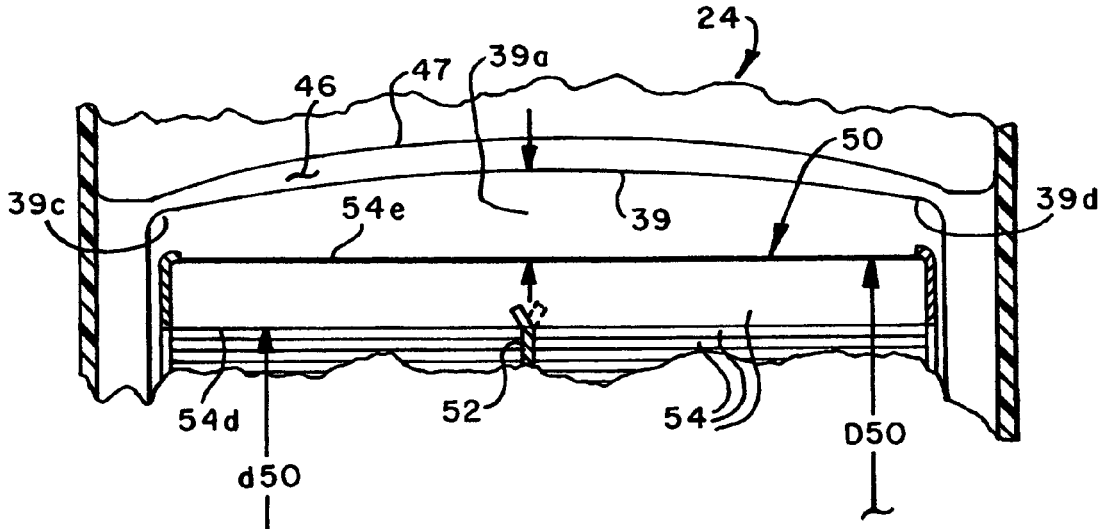
FIG. 6 is a view taken along the same line as FIG. 5 and showing the relationship between the cutoff edge and the outside diameter of an impeller of minimum diameter.

Referring now to FIG. 4, there is illustrated the blower housing 28 wherein the impeller 30 has been replaced by an impeller 50 having the same general construction as the impeller 30 and rotatable about axis 30*x*, but being of smaller outside and inside diameters, respectively. Blower impeller 50 is provided with plural circumferentially spaced blades 54 secured also to a center support or disc 52 including a motor shaft receiving hub 53, and wherein impeller 50 has an inner or inside diameter d50 defined as the diametral distance between opposed ones of the inner blade edges 54*d* and an outer or outside diameter D50, defined as the diametral distance between opposed ones of radially outer edges 54*e* of blades 54. In the arrangement of FIG. 4 the outer diameter D50 is approximately equal to the diameters of the orifices or air inlet ports 40 and 40*a*. FIG. 6 illustrates the relationship between the cutoff edge 39 and the impeller 50 wherein, of course, a greater distance is provided between the edge 39 and the radially outermost edges 54*e* of the impeller blades. Although the view of FIGS. 5 and 6 are taken generally from line 5-5 of FIG. 2, impellers 30 and 50 are also shown in section for illustrative purposes.

Accordingly, as shown and described, the diameters of the blower inlet ports or orifices 40 and 40*a* are generally no smaller than the inside diameter d30 of the largest diameter impeller or wheel 30 and generally no smaller than the outside diameter D50 of the smallest diameter wheel or impeller 50. In order to meet these conditions, the outside diameter D50 of the impeller 50 is no smaller than the inside diameter d30 of the impeller 30. Still further, the cutoff edge 39 is configured such that the radial clearance provided for the largest diameter impeller to be provided is the smallest and typically is about 1.0% to 2.0% of the impeller outside diameter. With these relationships the improved cutoff provided by the curved edge 39 still performs its intended purpose when the blower 24 is operating with the smallest diameter wheel or impeller, such as the impeller 50.

The construction and operation of a blower assembly, such as described herein is believed to be within the purview of one skilled in the art of air handling blowers for HVAC equipment and the like. Conventional engineering materials, including those described in the above-mentioned published patent applications, may be used to fabricate the blower housing 28 as well as the impellers 30 and 50. Moreover, those skilled in the art will also appreciate that impellers of respective inside and outside diameters in a range between the corresponding diameters of the impellers 30 and 50 may be utilized in conjunction with a housing such as the housing 28 without loss of blower performance and while enjoying the benefits of the invention. Thus, by providing a blower having the combination of a housing constructed in accordance with the invention as described herein and a range of impeller sizes from the diameters of the impeller 30 to the diameters of the impeller 50, various blowers may be constructed having airflow, discharge pressure and acoustic emission characteristics which may suit particular applications without requiring that blower housings of different sizes be furnished. In this way manufacturing complexity is reduced without sacrificing product performance or operating efficiency.

Figure 8:
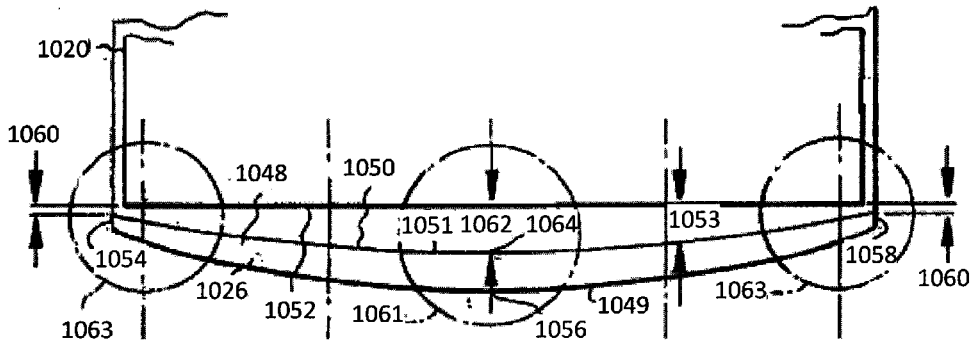
FIG. 8 is an end view of a blower and a cutoff.

FIG. 8 shows an end on view of a blower 1020 and cutoff 1026. The cutoff 1026 can be seen to have a face 1048 and a non-linear edge 1050 which are separated from a periphery 1052 of the blower 1020 by a varying distance 1053. The cutoff edge 1050 is the demarcation separating discharge airflow from recirculation. The cutoff face 1048 is formed as an area between a discharge side edge 1049 of the cutoff edge 1048 and a entrance side edge 1051 of the cutoff edge 1048. A particular cutoff angle, θ, defined as an angle between a line from a particular point on the cutoff edge 1048 to the axis 1012 and an arbitrary reference plane where the reference plane does not include the line.

The edge 1048 has a first end 1054, a midsection 1056 and a second end 1058. The area around the midsection 1056 forms an acoustical reduction portion 1061 promoting quieter airflow, whereas the areas around the first and second ends 1054, 1058 form efficiency enhancing portions 1063 inhibiting recirculation and promoting stability. A radial distance from the periphery 1052 of the blower is a first distance 1060 at the first and second ends 1054, 1058 and a second distance 1062 at the midsection 1056. In the preferred embodiment, the second distance 1062 is greater than the first distance 1060. Thus, the midsection 1056 is farther from the periphery 1052 than the first and second ends 1054, 1058, and distance between the cutoff edge 1050 and the periphery 1052 varies continuously therebetween.

The edge 1050 can be described as being symmetrical and continuous about a midpoint 1064 with the result that the edge 1050 forms an elliptical shape. In the acoustical reduction portion 1061, this elliptical shape has a first flattened arc relative to the axis 1012. In the efficiency enhancement portion 1063, the elliptical shape has a second sharper arc relative to the axis 1012.

Although a preferred embodiment of the invention has been described in detail herein those skilled in the art will recognize that various substitutions and modifications may be made without departing from the scope and spirit of the appended claims.

What is claimed is:

1. An air handling blower comprising:

a blower housing including at least one air inlet having a dimension defining an airflow area of said at least one inlet, an air outlet, an airflow space extending between said at least one inlet and said outlet and a cutoff edge in said housing substantially preventing recirculation of air in said space; and either a first impeller or a second impeller disposed for rotation about a common axis within said housing in said space, each of the first and second impellers having a plurality of blades having an inner edge and an outer edge where the inner edge is closer to the common axis than the outer edge, wherein said first impeller has an inside diameter defined as the diametral distance between its inner edges which is not less than said dimension of said at least one inlet and said second impeller has an outside diameter which is not less than said dimension of said at least one inlet;

wherein the cutoff edge comprises a first end having a first radial dimension relative to the common axis, a second end having a second radial dimension relative to the common axis, and a midsection having a third radial dimension relative to the common axis and wherein the third radial dimension is greater than the first or second radial dimensions; and wherein the cutoff edge arcs symmetrically from the first and second ends to the midsection.

2. The blower set forth in claim 1 wherein:

said housing is configured to provide said space with a substantially continuously increasing cross-sectional flow area with respect to said axis and extending from said cutoff edge toward said outlet.

3. The blower set forth in claim 1 wherein:

said at least one inlet is circular and said dimension is the diameter of said at least one inlet, said first impeller has an inside diameter determined by opposed radially inward edges of plural circumferentially spaced impeller blades which is not substantially greater than said diameter of said at least one inlet, and said second impeller has an outside diameter determined by opposed radially outermost edges of circumferentially spaced impeller blades which is not substantially greater than said diameter of said at least one inlet.

4. The blower set forth in claim 3 wherein:

said inside diameter of said first impeller is not substantially less than said outside diameter of said second impeller.

5. The blower set forth in claim 4 wherein:

the radial clearance between said impeller outside diameter and at least one of said portions of said cutoff edge is not less than one-half of one percent of said impeller outside diameter.

6. The blower set forth in claim 5 wherein:

said radial clearance between said impeller outside diameter and at least one portion of said cutoff edge is not more than five percent of said impeller outside diameter.

7. The blower set forth in claim 5 wherein:

the radial clearance between said impeller outside diameter and a cutoff edge portion extending between first and second end portions of said cutoff edge is not more than six percent of said impeller outside diameter.

8. The blower set forth in claim 1 wherein:

said cutoff edge has a substantially elliptical shape when viewed in a plane passing through said axis.

9. The blower set forth in claim 1 wherein:

said housing includes opposed air inlets formed therein for admitting air to said first impeller or said second impeller.

10. In an air handling blower for an HVAC system, a housing, including opposed air inlets substantially coaxially aligned with each other, an outer wall of said housing defining a spiral airflow space between said air inlets and an air outlet of said housing, a transverse cutoff edge formed by said housing to minimize recirculation of air within said space, said inlets and said cutoff edge being configured to accommodate centrifugal impellers adapted for rotation in said housing about a common axis, at least one inlet of said inlets having a dimension defining an airflow area of said at least one inlet, each of a first impeller and second impeller having a plurality of blades having an inner edge and an outer edge where the inner edge is closer to the common axis than the outer edge, and being of different outside and inside diameters, the inside diameter being the diametral distance between an impeller's inner edges wherein the inside diameter of the largest diameter impeller accommodated within said housing is not substantially less than the outside diameter of the smallest impeller accommodated within said housing;

wherein the cutoff edge comprises a first end having a first radial dimension relative to the common axis, a second end having a second radial dimension relative to the common axis, and a midsection having a third radial dimension relative to the common axis and wherein the third radial dimension is greater than the first or second radial dimensions; and wherein the cutoff edge arcs symmetrically from the first and second ends to the midsection.

11. The blower set forth in claim 10 wherein:

said housing is configured to provide said space with a substantially continuously increasing cross-sectional flow area with respect to said axis and extending from said cutoff edge toward said outlet.

12. The blower set forth in claim 10 wherein:

said inlets are circular, said first impeller has an inside diameter determined by opposed radially inward edges of plural circumferentially spaced impeller blades which is not substantially greater than the diameter of said inlets, and said second impeller has an outside diameter determined by opposed radially outermost edges of circumferentially spaced impeller blades which is not substantially greater than said diameter of said inlets.

13. The blower set forth in claim 12 wherein:

said inside diameter of said first impeller is not substantially less than said outside diameter of said second impeller.

14. The blower set forth in claim 13 wherein:

the radial clearance between said outside diameter and opposed portions of said cutoff edge is not less than one-half of one percent of said outside diameter.

15. The blower set forth in claim 14 wherein:

the radial clearance between said outside diameter and said opposed portions of said cutoff edge is not more than five percent of said outside diameter.

16. The blower set forth in claim 14 wherein:

the radial clearance between said outside diameter and a cutoff edge portion extending between said opposed portions of said cutoff edge is not more than six percent of said outside diameter.

17. The blower set forth in claim 10 wherein:

said cutoff edge has a substantially elliptical shape when viewed in a plane passing through said axis.

18. In an air handling blower for an HVAC system, a housing, including opposed substantially circular air inlets substantially coaxially aligned with each other with respect to a common axis, an outer wall of said housing defining an airflow space between said inlets and an air outlet of said housing, a transverse cutoff edge formed by said housing to minimize recirculation of air within said space, said space having a substantially continuously increasing cross-sectional flow area with respect to said axis and extending from said cutoff edge toward said outlet, said inlets and said cutoff edge being configured to accommodate centrifugal impellers adapted for rotation in said housing about said axis, each of a first impeller and second impeller having a plurality of blades having an inner edge and an outer edge where the inner edge is closer to the common axis than the outer edge, and being of different outside and inside diameters defined, respectively, by opposed outer and inner edges of circumferentially spaced impeller blades of said impellers wherein the inside diameter of the largest diameter impeller accommodated within said housing is about equal to the diameter of said inlets and is not substantially less than the outside diameter of the smallest impeller accommodated within said housing;

wherein the cutoff edge comprises a first cutoff end radially spaced from the common axis a first distance, a second cutoff end radially spaced from the axis by a second distance, and a cutoff midsection located between the first and second cutoff ends and radially spaced from the common axis by a third continuously varying distance where the third continuously varying distance has a magnitude greater than the first distance.

19. The blower set forth in claim 18 wherein:

the radial clearance between an outside diameter of at least one of the first impeller and second impeller and a portion of said cutoff edge is not less than one-half of one percent of said outside diameter.

20. The blower set forth in claim 18 wherein:

the radial clearance between said outside diameter and said portion of said cutoff edge is not more than five percent of said outside diameter.

21. The blower set forth in claim 20 wherein:

the radial clearance between said outside diameter and a cutoff edge portion extending between said portion of said cutoff edge is not more than six percent of said outside diameter.

22. The blower set forth in claim 21 wherein:

said cutoff edge has a substantially elliptical shape when viewed in a plane passing through said axis.

23. A blower arrangement comprising:

an impeller having an outer periphery of blades arranged about an axis, an impeller inside diameter, and an impeller outside diameter;

a housing arranged about the impeller, the housing having an inlet, the inlet having an inlet diameter, and an outlet and forming a first airflow path from the housing inlet to the impeller and forming a second airflow path from the impeller to the housing outlet;

a cutoff aligned between the blower and the outer periphery and separating the first and second airflow paths, the cutoff including a first cutoff end radially spaced from the axis a first distance, a second cutoff end radially spaced from the axis by a second distance, and a cutoff midsection located between the first and second cutoff ends and radially spaced from the axis by a third continuously varying distance where the third continuously varying distance has a magnitude greater than the first distance;

wherein the impeller inside diameter is less than the impeller outside diameter; and wherein the impeller outside diameter is greater than or equal to the inlet diameter while the impeller inside diameter is less than or equal to the inlet diameter.

* * * * *